US009868498B2

(12) United States Patent
Aasebo et al.

(10) Patent No.: US 9,868,498 B2
(45) Date of Patent: Jan. 16, 2018

(54) MODULAR AZIMUTH THRUSTER

(71) Applicant: Rolls-Royce Marine AS, Alesund (NO)

(72) Inventors: Steinar Aasebo, Gurskoy (NO); Rune Garen, Eiksund (NO)

(73) Assignee: Rolls-Royce Marine AS, Alesund (NO)

( * ) Notice: Subject to any disclaimer, the term of this patent is extended or adjusted under 35 U.S.C. 154(b) by 0 days.

(21) Appl. No.: 15/024,162

(22) PCT Filed: Sep. 24, 2014

(86) PCT No.: PCT/EP2014/070295
§ 371 (c)(1),
(2) Date: Mar. 23, 2016

(87) PCT Pub. No.: WO2015/044160
PCT Pub. Date: Apr. 2, 2015

(65) Prior Publication Data

US 2016/0229504 A1 Aug. 11, 2016

(30) Foreign Application Priority Data

Sep. 24, 2013 (EP) ..... 13185723

(51) Int. Cl.
*B63H 5/125* (2006.01)
*B63H 25/42* (2006.01)

(52) U.S. Cl.
CPC ..... *B63H 5/125* (2013.01); *B63H 25/42* (2013.01); *B63H 2005/1254* (2013.01); *B63H 2005/1256* (2013.01); *B63H 2005/1258* (2013.01)

(58) Field of Classification Search
CPC ..... B63H 5/125; B63H 25/42; B63H 2005/1258; B63H 2005/1256; B63H 2005/1254
See application file for complete search history.

(56) References Cited

U.S. PATENT DOCUMENTS 3,799,291 A 3/1974 Becker
6,648,704 B1 11/2003 Fontanille
(Continued)

FOREIGN PATENT DOCUMENTS

CN 102092466 6/2011
CN 102632982 8/2012
(Continued)

OTHER PUBLICATIONS

Machine Translation of EP2403751B1 by Lexis Nexis Total Patent on Mar. 23, 2016.
(Continued)

*Primary Examiner* — Anthony D Wiest
(74) *Attorney, Agent, or Firm* — Woodard, Emhardt, Moriarty, McNett & Henry LLP

(57) ABSTRACT

The present invention is directed to a modular azimuth thruster (1) for propelling a vessel, having a thruster housing (1) around which water flows, and comprising: a standardized core unit (2) having a core unit housing (21) forming part of the thruster housing, a transmission line (6) arranged within in the core unit housing (21), comprising a propeller shaft (61) extending in a longitudinal direction (13) of the thruster housing, and a propeller (3) arranged outside the thruster housing and being operationally connected to the propeller shaft. The present invention further relates to a vessel comprising an azimuth thruster and a method of configuring an azimuth thruster.

21 Claims, 5 Drawing Sheets

(56) References Cited

U.S. PATENT DOCUMENTS

| | | | |
|---|---|---|---|
| 8,851,942 | B2 | 10/2014 | Yoshikawa et al. |
| 9,592,897 | B2 | 3/2017 | Johnsen |
| 2007/0173140 | A1 | 7/2007 | Boebel |
| 2011/0142693 | A1 | 6/2011 | Van Buren |
| 2011/0318978 | A1 | 12/2011 | Krackhardt et al. |

FOREIGN PATENT DOCUMENTS

| | | | |
|---|---|---|---|
| CN | 101888948 | | 7/2013 |
| CN | 102548840 | | 5/2015 |
| EP | 1847455 | A1 | 3/2013 |
| EP | 2403751 | B1 | 4/2013 |
| FR | 2798184 | | 3/2001 |
| KR | 1020130023863 | A | 3/2013 |
| WO | WO 02/26558 | A1 | 4/2002 |

OTHER PUBLICATIONS

Machine Translation of KR1020130023863A by Lexis Nexis Total Patent on Mar. 23, 2016.

Machine Translation of CN102632982A by Lexis Nexis Total Patent on Mar. 29, 2017.

SECTION A-A

MODULAR AZIMUTH THRUSTER

FIELD OF THE INVENTION

The present invention relates to an azimuth thruster for propelling a vessel, having a thruster housing around which water flows, and comprising: a standardized core unit having a core unit housing forming part of the thruster housing, a transmission line arranged within the core unit housing, comprising a propeller shaft extending in a longitudinal direction of the thruster housing, and a propeller arranged outside the thruster housing and being operationally connected to the propeller shaft. The present invention further relates to a vessel comprising an azimuth thruster and a method of configuring an azimuth thruster.

BACKGROUND OF THE INVENTION

Azimuth thrusters, also known as pods, pod drives or gondola drives, are propulsion and steering units widely used in maritime vessels. Various configurations of azimuth thrusters are known, and they may be operated as either pushing azimuth thrusters having the propeller mounted in a downstream position, or as pulling azimuth thrusters having the propeller mounted in an upstream direction. Both pushing and pulling azimuth thrusters possess unique advantages and may be preferred in different situations, e.g. dependable on the design and operation of the vessel.

Traditionally, azimuth thrusters are made of materials such as cast iron and steel, these materials making thrusters very heavy due to their often considerable size. Heavy thrusters make assembly work and repair a cumbersome operation, often requiring that vessels are put in a dry dock.

Also, traditionally, azimuth thrusters are designed and manufactured according to the design and intended operation of a specific vessel. However, during the lifetime of a vessel the design and intended operation may change, making the original azimuth thruster less suitable. Further, as azimuth thrusters are often made to order for a specific vessel, standardization of components is difficult.

Consequently component quantities are low, resulting in inefficient production methods and higher production costs.

Hence, an improved azimuth thruster would be advantageous, and in particular an azimuth thruster enabling more efficient manufacturing processes, having a reduced weight and providing a more flexible area of use would be advantageous.

OBJECT OF THE INVENTION

In particular, it may be seen as a further object of the present invention to provide an azimuth thruster that solves the above mentioned problems of the prior art with regard to production, flexibility of use and weight.

SUMMARY OF THE INVENTION

Thus, the above described object and several other objects are intended to be obtained in a first aspect of the invention by providing an azimuth thruster for propelling a vessel, having a thruster housing around which water flows, and comprising: a standardized core unit having a core unit housing forming part of the thruster housing, a transmission line arranged within the core unit housing, comprising a propeller shaft extending in a longitudinal direction of the thruster housing, and a propeller arranged outside the thruster housing and being operationally connected to the propeller shaft, wherein, the azimuth thruster is configurable as both a pulling azimuth thruster and a pushing azimuth thruster by comprising first and second hydrodynamic elements mounted on matching first and second core unit interfaces defined by exterior surface areas of the core unit housing, the hydrodynamic elements forming part of the thruster housing to controlling the flow of water around the thruster housing, and the core unit interfaces are adapted for receiving different hydrodynamic elements having different hydrodynamic properties.

The invention is particularly, but not exclusively, advantageous for obtaining an azimuth thruster which may be configured as either a pulling azimuth thruster or a pushing azimuth thruster. To achieve this, it is desirable to have hydrodynamic elements on both a downstream facing side and an upstream facing side of the standardized core unit to be able to control the hydrodynamic properties of the thruster housing. In this regard it should be noted that the desired hydrodynamic properties of pulling azimuth thrusters may be very divergent from those of pushing azimuth thrusters. Thus, to be able to control the hydrodynamic properties of the thruster housing by changing the hydrodynamic elements is advantageous. A further advantage in this respect is that the hydrodynamic characteristics of the thruster may be specified late in the production process by only changing hydrodynamic elements. Hereby, a modular thruster concept is achieved, which increases component quantities and ensures an efficient production of tailored azimuth thrusters.

In one embodiment of the azimuth thruster, the transmission line further comprises bearings and gears, all of which are fully contained within the core unit housing.

By providing an azimuth thruster wherein the propeller shaft is the only part of the transmission line extending from the core unit housing into the surrounding water when the azimuth thruster is mounted on a vessel, only the imperviousness of the standardized core unit has to be ensured. Hereby the design of the connection between the hydrodynamic element and the standardized core unit may be subject to fewer requirements and the hydrodynamic elements may be replaced without concern for the imperviousness of the core unit of the azimuth thruster.

Furthermore, the thruster housing may comprise a stub part, one end of which is adapted for being mounting on a vessel, and a torpedo part arranged at an opposite end of the stub part, and wherein the hydrodynamic elements constitute part of both the stub part and part of the torpedo part.

Additionally, a torpedo section of the core unit housing forming part of the torpedo part may be wider than a stub section of the core unit housing forming part of the stub part in the longitudinal direction of the thruster housing.

By increasing the width of the torpedo section of the core unit housing, the distance between bearings carrying the propeller shaft may be increased, thereby improving the suspension of the propeller shaft.

Also, each of the core unit interfaces may be defined by one or more end faces of the core unit housing.

Further, the first core unit interface and the second core unit interface may be arranged on opposite sides of the thruster housing, facing in an upstream and a downstream direction, respectively.

In addition, the first core unit interface facing in the upstream direction may be substantially parallel with the second core unit interface facing in the downstream direction.

Also, the first and the second core unit interface may cover both the part of the core unit housing forming part of the stub part of the thruster housing and the part forming part of the torpedo part of the thruster housing.

Additionally, each of the core unit interfaces may be defined by multiple end faces of the core unit housing, the multiple end faces being offset in relation to one another in the longitudinal direction of the thruster housing.

In one embodiment of the azimuth thruster, the core unit housing is symmetrical about a plane of symmetry intersecting a centre axis of the core unit housing and extending in a direction transversal to the longitudinal direction of the thruster housing.

Furthermore, the core unit housing may be adapted for providing the structural integrity of the azimuth thruster by absorbing structural loads and bearing loads induced by the weight and operation of the azimuth thruster itself and hydro induced forces acting on the thruster housing during use.

By the core unit housing absorbing structural loads, bearing loads induced by the weight and operation of the azimuth thruster and hydro induced forces, great flexibility is achieved for the design of the hydrodynamic elements.

Also, the core unit housing may be made from cast iron.

Moreover, in one embodiment the hydrodynamic elements are made from non-metallic materials, such as composites, polymers, glass- or carbon fibre reinforced polymers or polyurethane.

By using materials other than the traditional cast iron and steel a reduction in weight is achieved and the shaping of the hydrodynamic elements is easier. Hereby the implementation of more advanced shapes of hydro dynamic elements is possible.

The azimuth thruster described above may further comprise a propeller nozzle encircling the propeller to improve operation and propeller effect.

Additionally, the core unit housing may form a minor part of the thruster housing and the hydrodynamic elements may form a major part of the thruster housing.

Also, a maximum width of the core unit housing in the longitudinal direction may be ⅓ to ¼ of a maximum width of the thruster housing in the longitudinal direction.

By implementing a core unit housing having a relative short width and/or size, the shape of the core unit housing has little impact on the overall hydrodynamic properties of the thruster. Hereby, a common standardized core unit housing for use in various thruster configurations may be achieved.

Moreover, a t/c-ration of the thruster housing may be configurable in the range from 0.2 to 0.6.

Still further, a width of the torpedo part of the core unit housing in the longitudinal direction may be in the range of 12-17 times a diameter of the propeller shaft.

The invention also relates to a vessel comprising an azimuth thruster.

Further, the invention relates to a method for configuring or for re-configuring the above described azimuth thruster, the method comprising the steps of: providing a standardized core unit, specifying hydrodynamic characteristics of the azimuth thruster, mounting hydrodynamic elements on the standardized core unit to meet the specified hydrodynamic characteristics.

Furthermore, the method may comprise the step of replacing a first and/or a second hydrodynamic element already mounted on the standardized core unit with a third and/or a fourth hydrodynamic element having different hydrodynamic properties.

The method for configuring the azimuth thruster clearly illustrates the beneficial effects of the proposed modular azimuth thruster. By using a standardized core unit, the hydrodynamic properties of the entire azimuth thruster may be specified and fixed at a relatively late stage in the manufacturing process. This should be compared to traditional thrusters wherein the hydrodynamic properties are determined earlier by the design of a common thruster housing. Also, the hydrodynamic properties of an already installed azimuth thruster according to the invention, may be re-configured by changing the hydrodynamic elements.

The above described aspects of the present invention may each be combined with any of the other aspects. These and other aspects of the invention will be apparent from and elucidated with reference to the embodiments described hereinafter.

BRIEF DESCRIPTION OF THE FIGURES

The azimuth thruster according to the invention will now be described in more detail with regard to the accompanying figures. The figures show one way of implementing the present invention and is not to be construed as being limiting to other possible embodiments falling within the scope of the attached claim set.

DETAILED DESCRIPTION OF EMBODIMENTS

Figure 1:
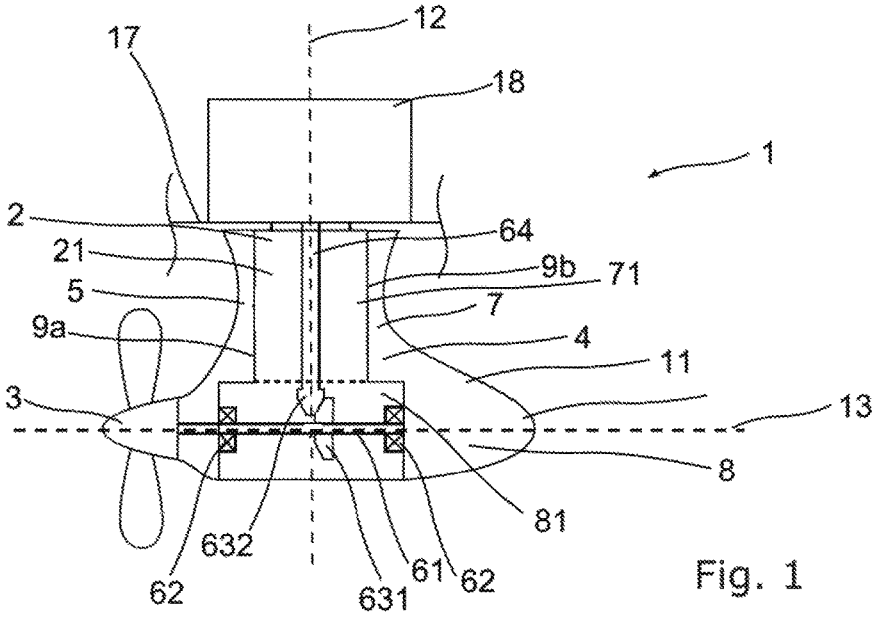
FIG. 1 shows a schematic drawing of an azimuth thruster according to one embodiment of the invention.

With reference to FIG. 1, the figure shows an azimuth thruster 1 for propelling a vessel 17, such as a ship, a floating production platform or the like. The azimuth thruster has a thruster housing 11 around which water flows, and comprises a standardized core unit 2 provided with first and second hydrodynamic elements 4, 5 and a propeller 3. The thruster housing 11 comprises a stub part 7 which is adapted for being rotatably mounting on a vessel, and a torpedo part 8 arranged at an opposite end of the stub part. The azimuth thruster 1 is rotatable about a centre axis 12 by one or more operating steering engines 18 provided above the azimuth thruster. Hereby a pulling or pushing force vector of the azimuth thruster can be orientated in a 360 degrees interval about the centre axis 12

Figure 4:
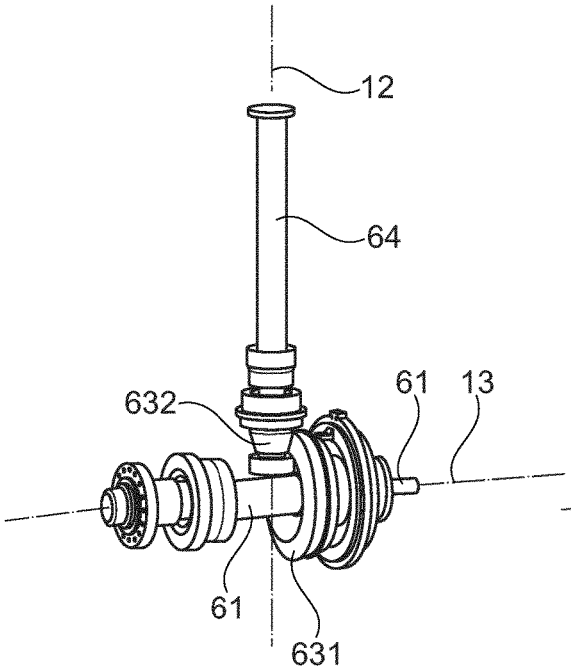
FIG. 4 shows a transmission line contained within the core unit housing.

The standardized core unit 2 has a core unit housing 21 forming part of the thruster housing 11. A transmission line comprising a propeller shaft 61 and a drive shaft 64 is arranged inside the core unit housing. The transmission line is shown in isolation in FIG. 4. The drive shaft 64 extends through the stub part of the thruster housing and into the vessel where it may be operably connected to driving means of the vessel (not shown), such as an onboard combustion engine. The propeller shaft 61 extends in a longitudinal direction 13 of the thruster housing and the propeller 3 is mounted on the drive shaft outside the thruster housing. The propeller shaft 61 is driven by a pinion gear 632 provided on the drive shaft 64, cooperating with a drive gear 631 arranged on the propeller shaft.

In another embodiment (not shown) driving means for driving the propeller, such as an electrical motor, may be arranged in the thruster housing of the azimuth thruster. Hereby, the propeller shaft may be directly associated with the driving means, making the drive shaft redundant.

Figure 9:
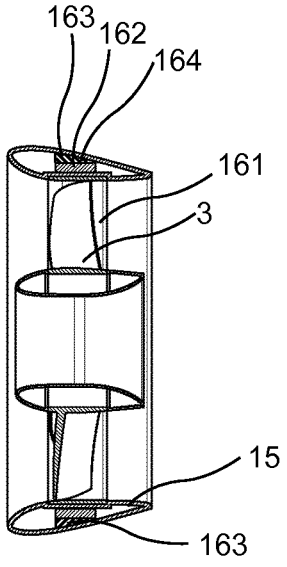
FIG. 9 shows a cross section of a propeller nozzle incorporating a permanent magnet motor.

As shown in FIG. 9, the electrical motor may be a permanent magnet motor arranged in or in connection with the thruster housing. The permanent magnet motor may be integrated in a propeller nozzle 15 of the azimuth thrusters thereby providing a rim-driven propeller. Alternatively, the permanent magnet motor may be arranged in the thruster housing providing an azimuth thruster with a shaft driven propeller. A rim-driven propeller may be implemented by arranging the propeller 3 in a propeller housing 161 provided with second permanent magnets 162 and rotatable arranged inside the propeller nozzle. Along an inner circumference of the propeller nozzle first permanent magnets 163 are arranged, and together the first and second permanent magnets provide a bearing for the propeller housing able to absorb both axial and radial loads. Further, the propeller nozzle constitutes a stator 164 comprising windings for providing a rotating magnetic field adapted to rotate the propeller housing, which constitutes a rotor by comprising permanent magnets. By controlling the current running through the windings, the propeller housing may be rotated and a permanent magnet motor for driving the propeller is provided.

Figure 2A:
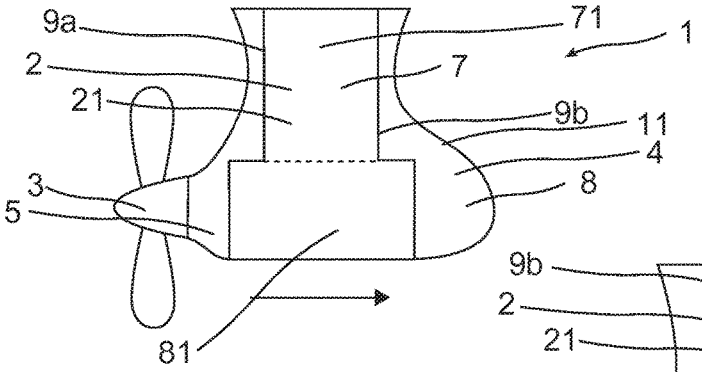
FIG. 2*a* shows a schematic drawing of a pushing azimuth thruster according to one embodiment of the invention.
Figure 2B:
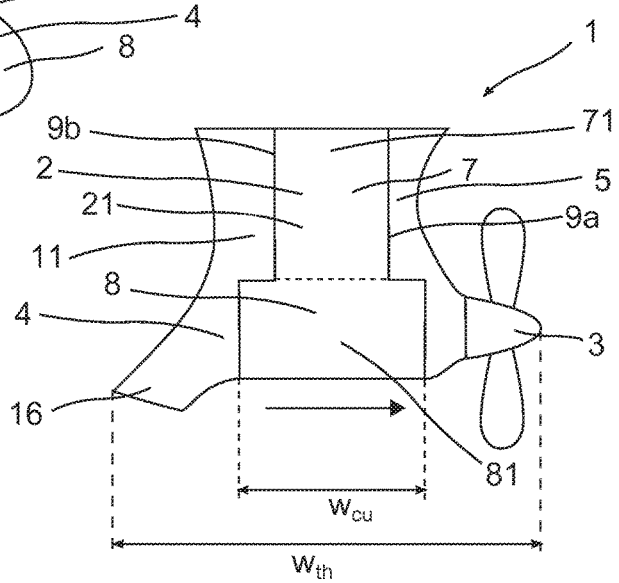
FIG. 2*b* shows a schematic drawing of a pulling azimuth thruster according to another embodiment of the invention.
Figure 3A:
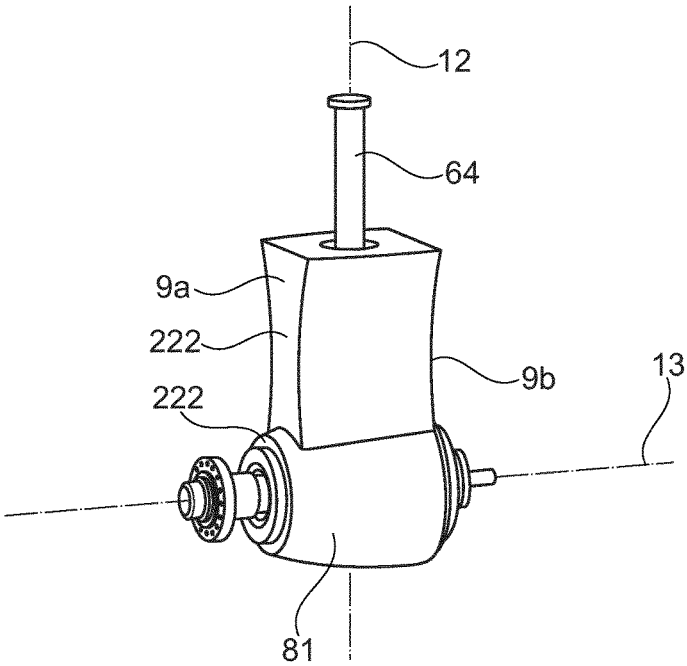
FIG. 3*a* shows one embodiment of a standardized core unit of an azimuth thruster.
Figure 3B:
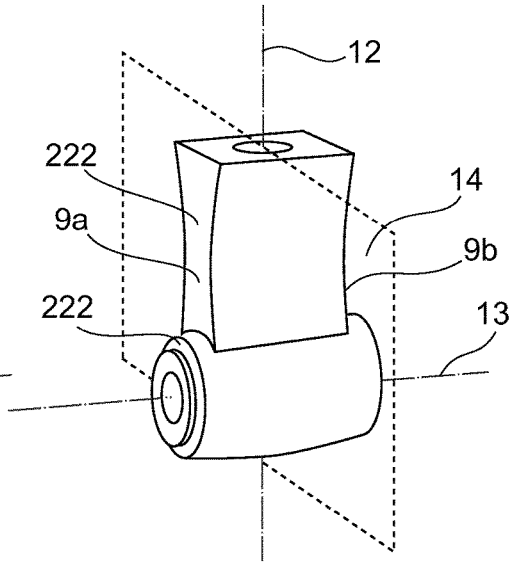
FIG. 3*b* shows another embodiment of a standardized core unit of an azimuth thruster.
Figure 8A:
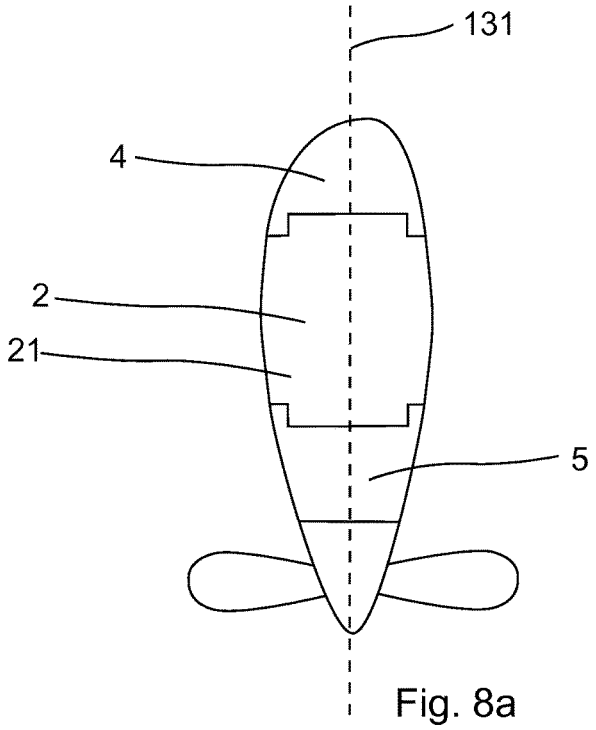
FIGS. 8*a* and 8*b* show different principles for mounting hydrodynamic elements on the core unit.
Figure 8B:
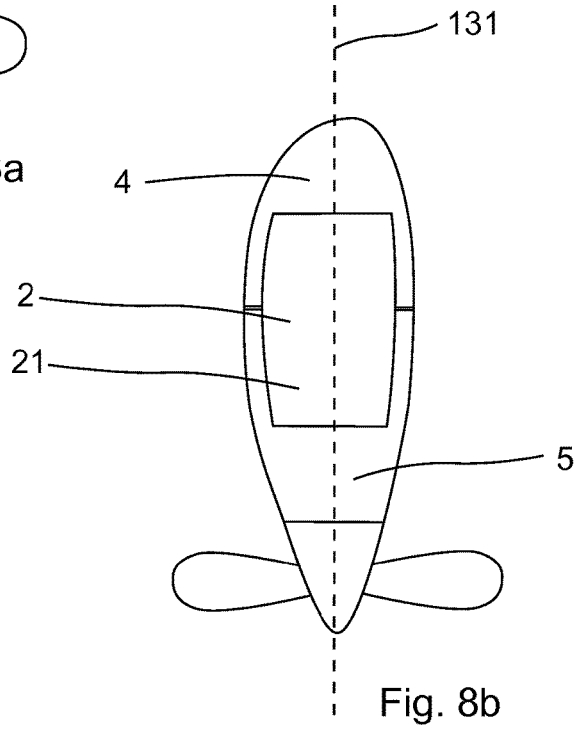

The standardized core unit shown in further detail in FIG. 2*a* and FIG. 3*b*, comprises first 9*a* and second 9*b* core unit interfaces defined by exterior surface areas of the core unit housing 21. The hydrodynamic elements 4, 5 are mounted on the core unit housing at the at first 9*a* and second 9*b* core unit interfaces, thereby forming part of the thruster housing. The core unit interfaces are adapted for receiving different hydrodynamic elements having different hydrodynamic properties, i.e. varying shape and size as shown in FIG. 2*a* and FIG. 2*b*. Various principles for the design of the core unit interfaces and for the mounting of the hydrodynamic elements 4, 5 on the core unit housing 21 may be envisaged by the skilled person. For example, the hydrodynamic elements may simply abut on the core unit interfaces 9*a*, 9*b* or alternatively partly or fully overlap the core unit housing as shown in FIGS. 8*a* and 8*b*. FIG. 8*a* shows an azimuth thruster wherein the hydrodynamic elements partly overlap the core unit housing 21. FIG. 8*b* shows an embodiment of the azimuth thruster wherein the standardized core unit 2 and thus the core unit housing 21 are enclosed by the hydrodynamic elements 4, 5. The core unit housing 21 may be either partly of fully enclosed by the hydrodynamic elements, whereby the hydrodynamic elements may be joined to one another in one exemplary embodiment.

The hydrodynamic elements may be chosen such that the desired hydrodynamic properties of the thruster housing is achieved, but also in accordance with whether the azimuth thruster is a pulling or a pushing azimuth thruster. Hereby, the azimuth thruster is configurable as both a pulling and a pushing azimuth thruster.

As shown in the figures, the hydrodynamic elements 4, 5 constitute a part of both the stub part 7 and the torpedo part 8 of the thruster housing, thereby having a substantial impact on the hydrodynamic properties of the azimuth thruster. By varying the shape of the hydrodynamic elements 4, 5, length and surface areas of the thruster housing may thus be controlled.

Figure 7:
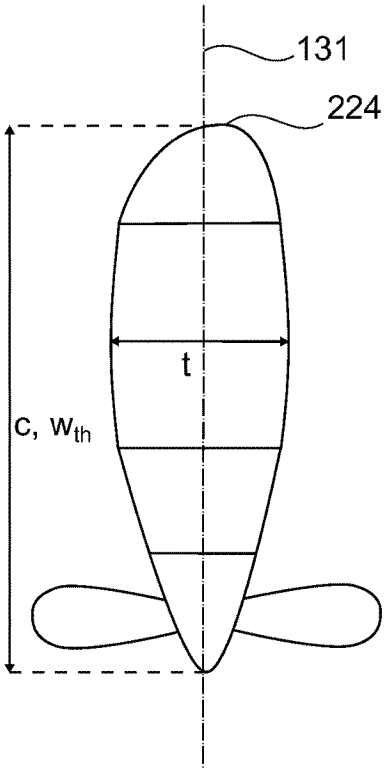
FIG. 7 shows a schematic drawing illustrating an azimuth thruster having a twisted leading edge.

Referring to FIG. 7, the hydrodynamic elements may also be used for controlling the t/c-ration of the thruster housing, which is the relationship between the cord length, i.e. the maximum width, $W_{th}$ of the thruster housing in the longitudinal direction, and the thickness of the thruster housing, i.e. the maximum width of the thruster housing in a transversal direction.

A further effect of the modular design is that the hydrodynamic elements may be used to control the twist of the thruster housing, i.e. the position of a leading edge 224 of the thruster housing with respect to a centre axis 131 extending in the longitudinal direction of the thruster housing, as shown in FIG. 7. The necessary twist may depend on whether the thruster is a pulling or a pushing thruster, intended speed of the vessel, direction of rotation of the propeller, propeller load, etc.

Referring again to FIG. 2, it is shown that a torpedo section 81 of the core unit housing forming part of the torpedo part 8, is wider in the longitudinal direction, than a stub section 71 of the core unit housing forming part of the stub part 7. By using such configuration a distance between bearings 62 carrying the propeller shaft 61 may be increased while keeping the width of the stub part of the core unit housing at a minimum. From FIG. 2*b* it is also seen that a maximum width, $W_{cu}$ of the core unit housing in the longitudinal direction is ⅓ to ¼ of a maximum width, $W_{th}$ of the thruster housing in the longitudinal direction.

Reducing the width of the core unit housing in general, reduces the impact of the core unit housing on the overall hydrodynamic properties of the thruster housing. A further advantageous effect of the increased width of the torpedo section 81 of the standardized core unit is that each of the core unit interfaces 9*a*, 9*b* are defined by multiple end faces 222 of the core unit housing being offset in relation to one another. This configuration of the core unit interfaces may result in the creation of an improved connection between the core unit housing and the hydrodynamic elements.

Figure 5:
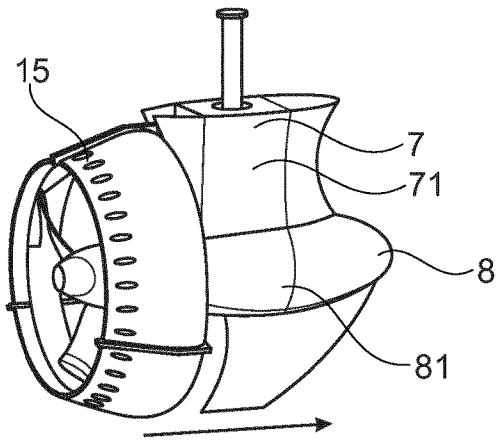
FIG. 5 shows a pushing azimuth thruster according to one embodiment of the invention.

FIG. 2*a* and FIG. 5 show azimuth thrusters configured as a pushing azimuth thruster indicated by the direction of the arrow. The pushing azimuth thruster has the propeller mounted on a downstream side of the thruster housing. In the embodiment shown in FIG. 5, the thruster further comprises a propeller nozzle 15 encircling the propeller to improve operation and propeller effect.

Figure 6:
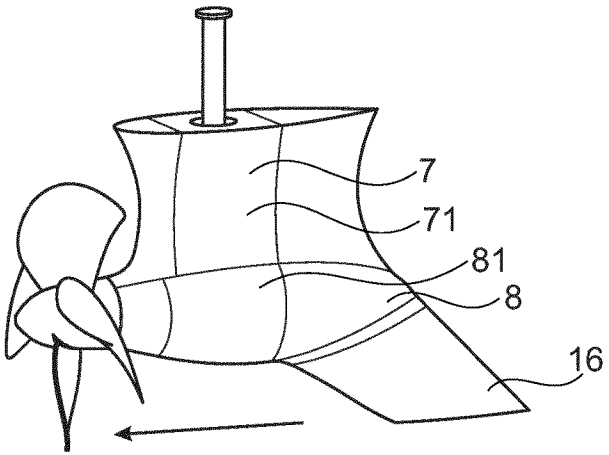
FIG. 6 shows a pulling azimuth thruster according to another embodiment of the invention.

FIG. 2*b* and FIG. 6 both show azimuth thrusters configured as a pulling azimuth thruster indicated by the direction of the arrow. The pulling azimuth thruster has the propeller mounted on an upstream side of the thruster housing and the thruster may further be provided with a fin element 16 extending from the torpedo part in order to increase a total exterior surface area of the thruster housing.

As shown in FIG. 1 and described above, the azimuth thruster extends from a vessel 17 comprising one or more steering engines 18 for turning the thruster. In one embodiment the steering engine(s) may be an electrical of hydraulic motor cooperating with a gear rim (not shown) provided at an end of the stub part 7 rotatably mounted on the vessel. When dimensioning the mounting for the azimuth thruster including the steering engine, the torque required for turning the azimuth thruster should be considered. The torque required to turn the azimuth thruster depends on several variables such as the hydrodynamic properties of the thruster housing, thruster rotation rate, propeller rotation and vessel speed. In this regard EP1847455A1 discloses an azimuth thruster wherein a pinion gear driving the propeller axis, produces a torque that acts against a resistance torque of the azimuth thruster associated with turning the thruster during operation. Hereby, the torque generated by rotation of the pinion gear is used to counter act the torque resistance of the thruster, thereby reducing the torque required to turn the azimuth thruster during operation. This, in turn, may result in a reduction in the size and/or number of steering engines required to turn the azimuth thruster.

Further, if an azimuth thruster according to the invention is to be used as both a pulling and a pushing azimuth thruster, the skilled person will know that the mounting should be dimensioned according to the forces action on the azimuth thruster when in pull configuration. This is due to the general observation that the torque required to turn a pulling azimuth thruster is larger than the torque required for turning a corresponding pushing azimuth thruster.

In the following, a method for configuring, i.e. manufacturing from standardized components, embodiments of the above described azimuth thruster will be described in further detail.

Various embodiments of both pushing and pulling azimuth thrusters having unique hydrodynamic properties may be configured based on the same standardized core unit 2. To produce an azimuth thruster according to the invention a standardized core unit 2 is provided. Variations of a standardized core unit may exist in that the mount for the propeller 3 may be provided on either side of the core unit housing 21, and the composition and dimensioning of the transmission line may vary. Secondly, it is determined whether the specific azimuth thruster 1 should be of the pushing or the pulling type, and the desired hydrodynamic characteristics are specified. Based on the specified hydrodynamic characteristics of the azimuth thruster, the appropriate hydrodynamic elements 4, 5 are chosen and mounted on the standardized core unit.

A considerable advantageous effect in this respect is that a customised azimuth thruster 1 may be build based on standardized components. One advantage of using standardized components is that product variation is introduced late in the end product process. Standardized components can thus be produced before the exact specifications of the future azimuth thrusters are known. Hereby, the production time from order to delivery may be reduced and the use of standardized components may increase quantities. By increasing quantities, a more efficient production process may be utilized. Especially, when it comes to the use of composite or non-metallic materials for the hydrodynamic elements, efficient productions processes are of crucial importance. Making customised azimuth thrusters from composite material without the use of standardized components is very cost ineffective and uncompetitive. In order to be able to use composite or non-metallic materials in azimuth thrusters, it is therefore crucial that standardized components are integrated in the design.

A further advantage of an azimuth thruster 1 according to the invention is that the azimuth thruster may be re-configured by replacing one or both of the hydrodynamic elements 4, 5 already mounted on the standardized core unit. If for example the design is altered of a vessel on which the azimuth thruster 1 is mounted, or the pattern of use changes, it may be advantageous to change the hydrodynamic properties of the azimuth thruster 1. In particular, an azimuth thruster according to an embodiment of the invention may be re-configured to alter the twist or the t/c-ration of the thruster housing. Instead of having to install a completely new azimuth thruster on the vessel, the hydrodynamic properties of an azimuth thruster according to the present invention may be changed by simply changing the hydrodynamic elements 4, 5.

As would be readily understood by the person skilled in the art, for an azimuth thruster to be configurable as both a pushing and a pulling azimuth thruster, both the shape of a leading part and a trailing part of the thruster housing must be controllable to arrive at an azimuth thruster having optimal hydrodynamic properties. This is achieved by the present invention by the use of hydrodynamic elements arranged on both sides of the core unit housing.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. An azimuth thruster for propelling a vessel, having a thruster housing around which water flows, and comprising:

a standardized core unit having a core unit housing forming part of the thruster housing, wherein the thruster housing comprises a stub part, one end of which is adapted for being rotatably mounted on a vessel, and a torpedo part arranged at an opposite end of the stub part, a transmission line arranged within in the core unit housing, comprising a propeller shaft extending in a longitudinal direction of the thruster housing, and a propeller arranged outside the thruster housing and being operationally connected to the propeller shaft, wherein, the azimuth thruster is configurable as both a pulling azimuth thruster and a pushing azimuth thruster by comprising first and second hydrodynamic elements mounted on matching first and second core unit interfaces defined by exterior surface areas of the core unit housing, the hydrodynamic elements forming part of the thruster housing to control the flow of water around the thruster housing, the core unit interfaces being adapted for receiving different hydrodynamic elements having different hydrodynamic properties and wherein the first hydrodynamic element constitutes a part of both the stub part and of the torpedo part.

2. An azimuth thruster according to claim 1, wherein the transmission line further comprises bearings and gears, all of which are fully contained within the core unit housing.

3. An azimuth thruster according to claim 1, wherein the second hydrodynamic elements constitute a part of both the stub part and of the torpedo part.

4. An azimuth thruster according to claim 3, wherein a torpedo section of the core unit housing forming part of the torpedo part, is wider than a stub section of the core unit housing forming part of the stub part in the longitudinal direction of the thruster housing.

5. An azimuth thruster according to claim 3, wherein a width of the torpedo part of the core unit housing in the longitudinal direction is 12-17 times the diameter of the propeller shaft.

6. An azimuth thruster according to claim 1, wherein each of the core unit interfaces are defined by one or more end faces of the core unit housing.

7. An azimuth thruster according to claim 1, wherein the core unit housing is symmetrical about a plane of symmetry intersecting a centre axis of the core unit housing and extending in a direction transversal to the longitudinal direction of the thruster housing.

8. An azimuth thruster according to claim 1, wherein the core unit housing is adapted for providing the structural integrity of the azimuth thruster by absorbing structural loads and bearing loads induced by the weight and operation of the azimuth thruster itself and hydro induced forces acting on the thruster housing during use.

9. An azimuth thruster according to claim 1, wherein the hydrodynamic elements are made from non-metallic materials, including composites, polymers, glass- or carbon fibre reinforced polymers or polyurethane.

10. An azimuth thruster according to claim 1, wherein the hydrodynamic elements partly overlap or enclose the standardized core unit.

11. An azimuth thruster according to claim 1, wherein a maximum width, of the core unit housing in the longitudinal direction is ⅓ to ¼ of a maximum width, of the thruster housing in the longitudinal direction.

12. An azimuth thruster according to claim 1, wherein a t/c-ration of the thruster housing is configurable in the range from 0.2 to 0.6.

13. An azimuth thruster according to claim 1, wherein a driving means for driving the propeller is an electrical motor in the form of a permanent magnet motor.

14. An azimuth thruster according to claim 13, wherein the propeller is rim-driven by first permanent magnets being provided in the propeller nozzle and second permanent magnets being arranged in connection with the propeller thereby providing a bearing for the propeller able to absorb axial and radial loads, and wherein the permanent magnet motor is integrated in the propeller nozzle by the propeller nozzle comprising windings for providing a rotating magnetic field adapted rotate the propeller.

15. A vessel comprising an azimuth thruster according to claim 1.

16. A method for configuring or re-configuring the hydrodynamic characteristics of an azimuth thruster according to claim 1, comprising the steps of:

providing a standardized core unit specifying hydrodynamic characteristics of the azimuth thruster, mounting hydrodynamic elements on the standardized core unit to meet the specified hydrodynamic characteristics.

17. A method according to claim 16, further comprising the step of:

replacing a first hydrodynamic element already mounted on the standardized core unit with a third hydrodynamic element having different hydrodynamic properties.

18. A method according to claim 17, further comprising the step of:

replacing a second hydrodynamic element already mounted on the standardized core unit with a fourth hydrodynamic element having different hydrodynamic properties.

19. An azimuth thruster according to claim 1, wherein both first and second ends of the propeller shaft are adapted to connect to the propeller, wherein the propeller connects to the first end when the azimuth thruster is configured as the pulling azimuth thruster and wherein the propeller connects to the second end when the azimuth thruster is configured as the pushing azimuth thruster.

20. An azimuth thruster according to claim 1, wherein a portion of the first hydrodynamic element is positioned between the standardized core unit and the propeller and wherein a cross-sectional area of the first hydrodynamic element decreases as it extends away from the standardized core unit toward the propeller.

21. A method for configuring or re-configuring the hydrodynamic characteristics of an azimuth thruster according to claim 1, comprising the steps of:

providing the standardized core unit;

determining whether the azimuth thruster is configured as the pulling or pushing azimuth thruster;

selecting the first and second hydrodynamic elements from first and second pulling hydrodynamic elements and first and second pushing hydrodynamic elements;

wherein a shape of the first and second pulling hydrodynamic elements is different than a shape of the first and second pushing hydrodynamic elements;

mounting the selected first and second hydrodynamic elements on the standardized core unit.

* * * * *